US009938604B2

(12) United States Patent
Takahashi et al.

(10) Patent No.: US 9,938,604 B2
(45) Date of Patent: Apr. 10, 2018

(54) METHOD FOR PRODUCING PELLETS AND METHOD FOR PRODUCING IRON-NICKEL ALLOY

(71) Applicant: SUMITOMO METAL MINING CO., LTD., Tokyo (JP)

(72) Inventors: Junichi Takahashi, Tokyo (JP); Taku Inoue, Tokyo (JP); Shuuji Okada, Tokyo (JP)

(73) Assignee: SUMITOMO METAL MINING CO., LTD., Tokyo (JP)

( * ) Notice: Subject to any disclaimer, the term of this patent is extended or adjusted under 35 U.S.C. 154(b) by 0 days.

(21) Appl. No.: 15/328,692

(22) PCT Filed: Jun. 30, 2015

(86) PCT No.: PCT/JP2015/068856
§ 371 (c)(1),
(2) Date: Jan. 24, 2017

(87) PCT Pub. No.: WO2016/017348
PCT Pub. Date: Feb. 4, 2016

(65) Prior Publication Data

US 2017/0211166 A1 Jul. 27, 2017

(30) Foreign Application Priority Data

Aug. 1, 2014 (JP) ..... 2014-157577

(51) Int. Cl.
*C22B 1/16* (2006.01)
*C22B 5/10* (2006.01)
(Continued)

(52) U.S. Cl.
CPC ..... *C22B 23/02* (2013.01); *B22F 9/20* (2013.01); *C21B 11/00* (2013.01); *C21B 13/00* (2013.01);
(Continued)

(58) Field of Classification Search
CPC ..... C22B 1/2406; C22B 5/10; C22C 33/04; C22C 33/02
See application file for complete search history.

(56) References Cited

U.S. PATENT DOCUMENTS 2,960,396 A * 11/1960 De Vaney ..... C22B 1/2406 75/755
3,525,604 A * 8/1970 Van Dornick ..... C21B 13/10 75/502
(Continued)

FOREIGN PATENT DOCUMENTS

CN 101886171 A 11/2010
CN 102409127 A * 4/2012
(Continued)

OTHER PUBLICATIONS

Qu Lishuang, CN 103436766—A machine translation (Year: 2013).*
(Continued)

*Primary Examiner* — George Wyszomierski
*Assistant Examiner* — Tima M McGuthry Banks
(74) *Attorney, Agent, or Firm* — Locke Lord LLP

(57) ABSTRACT

Provided is a method for producing pellets by which, when nickel oxide ore is being pelletized and smelted to produce ferronickel, which is an iron-nickel alloy, it is possible to allow the smelting reaction to proceed effectively. A method for producing pellets according to the present invention is for producing pellets which are used in producing iron-nickel alloy and which are produced by mixing raw materials including nickel oxide ore and agglomerating the resulting mixture, wherein the method comprises: a mixing step S11 for mixing at least nickel oxide ore, a carbonaceous reducing agent, and iron oxide to generate a mixture; and a pellet formation step S12 for agglomerating the resulting mixture and forming pellets. In the mixing step S11, the
(Continued)

mixture is generated such that the total weight of nickel and iron accounts for 30 wt % or more of the total weight of the pellets formed.

8 Claims, 2 Drawing Sheets

(51) Int. Cl.

| | |
|---|---|
| ***C22C 33/02*** | (2006.01) |
| ***C22C 33/04*** | (2006.01) |
| ***C22B 23/02*** | (2006.01) |
| ***B22F 9/20*** | (2006.01) |
| ***C21B 11/00*** | (2006.01) |
| ***C21B 13/00*** | (2006.01) |
| ***C22B 1/24*** | (2006.01) |

(52) U.S. Cl.
CPC ..... *C22B 1/24* (2013.01); *C22B 1/2406* (2013.01); *C22B 5/10* (2013.01); *C22C 33/02* (2013.01); *C22C 33/04* (2013.01)

(56) References Cited

U.S. PATENT DOCUMENTS

| | | | | |
|---|---|---|---|---|
| 3,847,601 | A | 11/1974 | Itoh et al. | |
| 4,197,115 | A * | 4/1980 | Suzuki | C21B 5/008 264/117 |
| 4,659,374 | A * | 4/1987 | Alanko | C22B 1/244 420/478 |
| 5,178,666 | A | 1/1993 | Diaz et al. | |
| 2005/0211020 | A1 | 9/2005 | Sugitatsu et al. | |
| 2011/0023656 | A1 | 2/2011 | Kunii et al. | |

FOREIGN PATENT DOCUMENTS

| | | | | |
|---|---|---|---|---|
| CN | 102816922 | A | * | 12/2012 |
| CN | 103436766 | A | * | 12/2013 |
| EP | 1553196 | A1 | * | 7/2005 |
| JP | 49-010110 | A | | 1/1974 |
| JP | 06-025770 | A | | 2/1994 |
| JP | 2004-156140 | A | | 6/2004 |
| JP | 2007-169774 | A | | 7/2007 |
| JP | 2012-062505 | A | | 3/2012 |
| WO | 2013/188922 | A1 | | 12/2013 |
| WO | WO-2014190391 | A | * | 12/2014 |

OTHER PUBLICATIONS

Liu, P et al., CN 102816922—A machine translation (Year: 2012).*
Chuanjie Wang et al., CN 102409127—A machine translation (Year: 2012).*
Cornwall, H. R., "Nickel Deposits of North America." Geological Survey Bulletin 1223. United States Government Printing Office, Washington, DC (Year: 1966).*
Muwanguzi et al., "Characterization of Chemical Composition and Microstructure of Natural Iron Ore from Muko Deposits." Internationational Scholarly Research Network vol. 2012, Article ID 174803 doi:10.5402/2012/174803. (Year: 2012).*
Crosby, William Otis, Common Minerals and Rocks. DC Heath & Co, Boston, p. 47. (Year: 1881).*
International Search Report dated Sep. 29, 2015, issued for PCT/JP2015/068856.
Extended European Search Report dated Jul. 21, 2017, issued to EP Patent Application No. 15827988.5.
Office Action dated Aug. 29, 2017, issued to CN Patent Application No. 201580039607.3.

* cited by examiner

METHOD FOR PRODUCING PELLETS AND METHOD FOR PRODUCING IRON-NICKEL ALLOY

CROSS REFERENCE TO RELATED APPLICATIONS

This application is related to co-pending applications: "METHOD FOR SMELTING NICKEL OXIDE ORE" filed even date herewith in the names of Junichi TAKAHASHI, Taku INOUE and Shuuji OKADA as a national phase entry of PCT/JP2015/068855; and "METHOD FOR SMELTING NICKEL OXIDE ORE" filed even date herewith in the names of Junichi TAKAHASHI, Taku INOUE and Shuuji OKADA as a national phase entry of PCT/JP2015/069849; which applications are assigned to the assignee of the present application and all three incorporated by reference herein.

TECHNICAL FIELD

The present invention relates to a method for producing pellets, and in more detail, relates to a method for producing pellets upon processing in a smelting step of nickel oxide ore, and a method for producing iron-nickel alloy using this.

BACKGROUND ART

As methods for smelting nickel oxide ore called limonite or saprolite, a method of dry smelting that produces nickel matt using a flash smelting furnace, a method of dry smelting that produces ferronickel using a rotary kiln or moving hearth furnace, a method of wet smelting that produces a mix sulfide using an autoclave, etc. have been known.

Upon charging the nickel oxide ore to the smelting step, pre-processing is performed for pelletizing, making into a slurry, etc. the raw material ore. More specifically, upon pelletizing the nickel oxide ore, i.e. producing pellets, it is common to mix components other than this nickel oxide ore, e.g., binder and reducing agent, then further perform moisture adjustment, etc., followed by charging into agglomerate producing equipment to make a lump on the order of 10 to 30 mm, for example (indicated as pellet, briquette, etc.; hereinafter referred to simply as "pellet").

Ferronickel is an alloy of iron (Fe) and nickel (Ni), and is made as a raw material of stainless steel mainly; however, if the smelting reaction (reduction reaction) of the aforementioned pellets advances ideally, since one ferronickel grain is obtained for one of these pellets, it is possible for a comparatively large ferronickel grain to be obtained.

When considering the efficiency of recovering ferronickel grains from a reducing furnace after the reduction reaction, the grain size is important, and if the ferronickel grain splits in the course of the reduction reaction, not only will handling become difficult, but time and labor will be required in recovery, and depending on the case, a novel recovery apparatus becomes necessary; therefore, it is very disadvantageous in terms of cost.

For example, Patent Document 1 discloses technology of adjusting excess carbon content of the mixture in a mixing step to make a mixture by mixing raw materials including nickel oxide and iron oxide with carbonaceous reducing agent, as a pre-treatment method upon producing ferronickel using a moving hearth furnace.

However, upon producing pellets in the aforementioned way, in the case of nickel oxide ore being a raw material, if producing ferronickel, which is an iron-nickel alloy, by adjusting the raw material components other than nickel oxide ore in order to make so that the smelting reaction progresses effectively, the size of the obtained ferronickel grains will become smaller at the moment when the smelting reaction ends.

If the size of the obtained ferronickel grain becomes smaller, there are problems in that this ferronickel is far smaller than the size of the pellets with a diameter on the order of 10 mm to 30 mm, and split to no more than several millimeters; therefore, handling upon recovering from the reducing furnace is very difficult, and the recovery rate declines.

In other words, in a smelting method for producing ferronickel, which is an iron-nickel alloy, from nickel oxide ore, it is preferable to satisfy both conditions of: (1) the smelting reaction progressing effectively; and (2) suppressing the obtained ferronickel from splitting into small grains; however, with the conventional smelting technology, it is not possible to adequately satisfy the condition (2) in particular, and thus brings about a decline in recovery rate.

Patent Document 1; Japanese Unexamined Patent Application, Publication No. 2004-156140

DISCLOSURE OF THE INVENTION

Problems to be Solved by the Invention

The present invention has been proposed taking account of such a situation, and has an object of providing a method for producing pellets, upon producing ferronickel, which is an iron-nickel alloy, by pelletizing nickel oxide ore and smelting, that can cause the smelting reaction to progress effectively, and suppress the ferronickel obtained after the smelting reaction from becoming small grains.

Means for Solving the Problems

The present inventors have thoroughly investigated in order to solve the aforementioned problem. As a result thereof, it was found that, upon producing pellets, when generating a mixture by mixing at least nickel oxide ore, carbonaceous reducing agent and iron oxide, by preparing a mixture so that the total weight of nickel and iron accounting for the total weight of the obtained pellet becomes at least a predetermined proportion, it becomes a pellet for which the smelting reaction will progress effectively, and can suppress splitting of ferronickel, which is an iron-nickel alloy obtained after the smelting reaction. In other words, the present invention provides the following matters.

A first aspect of the present invention is a method for producing pellets to be used for producing an iron-nickel alloy, and produced by agglomerating a mixture obtained by mixing raw materials including nickel oxide ore, the method including: a mixing process step of generating a mixture by mixing at least the nickel oxide ore, a carbonaceous reducing agent and iron oxide; and a pellet formation step of forming a pellet by agglomerating the mixture obtained, in which a mixture is generated in the mixing process step such that a proportion of a total weight of nickel and iron accounting for the total weight of the pellet formed is at least 30 wt %.

According to a second aspect of the present invention, in the method for producing pellets as described in the first aspect, the nickel oxide ore is limonite or saprolite, and a mixture is generated in the mixing process step such that a proportion of a total weight of nickel and iron accounting for the total weight of the pellet formed is no more than 45 wt %.

A third aspect of the present invention, in the method for producing an iron-nickel alloy that produces the iron-nickel alloy from nickel oxide ore, the method including: a pellet production step of producing a pellet from the nickel oxide ore; and a reduction step of heating the pellet obtained at a predetermined reduction temperature, in which the pellet production step includes: a mixing process step of generating a mixture by mixing at least the nickel oxide ore, a carbonaceous reducing agent and iron oxide; and a pellet formation step of forming a pellet by agglomerating the mixture obtained, and in which a mixture is generated in the mixing process step such that a proportion of a total weight of nickel and iron accounting for the total weight of the pellet formed is at least 30 wt %.

Effects of the Invention

According to the present invention, upon producing ferronickel, which is an iron-nickel alloy, using pellets of nickel oxide ore, it is possible to cause the smelting reaction to progress effectively, and suppress the ferronickel obtained after the smelting reaction from becoming small grains.

PREFERRED MODE FOR CARRYING OUT THE INVENTION

Hereinafter, a specific embodiment of the present invention (hereinafter referred to as "present embodiment") will be explained in detail while referencing the drawings. It should be noted that the present invention is not to be limited to the following embodiment, and that various modifications within a scope not departing from the gist of the present invention are possible.

<<1. Method for Smelting Nickel Oxide Ore>>

First, a method for smelting nickel oxide ore, which is raw material ore, will be explained. Hereinafter, it will be explained giving as an example a method for smelting (that produces ferronickel (method for producing ferronickel) by pelletizing nickel oxide ore, which is the raw material ore, then generates metal (iron-nickel alloy (hereinafter iron-nickel alloy is referred to as "ferronickel")) and slag by reduction treating these pellets, and then separates this metal and slag.

Figure 1:
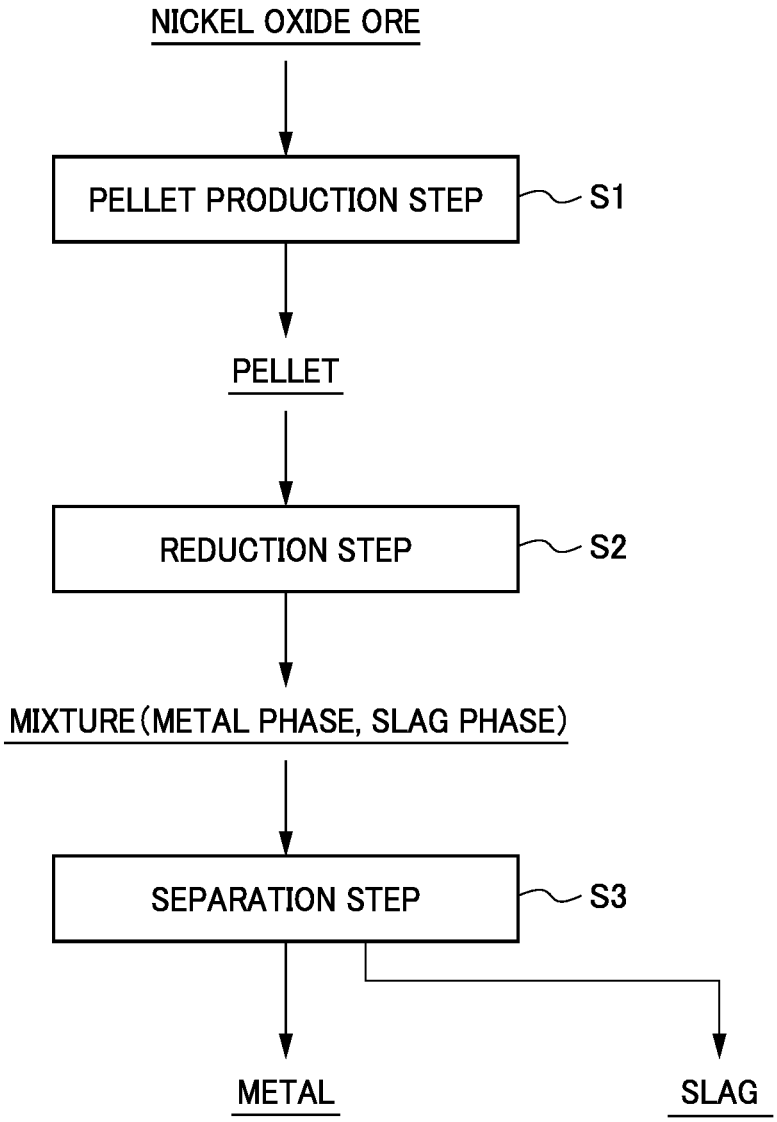
FIG. 1 is a process drawing showing the flow of a method for smelting nickel oxide ore.

The method for smelting nickel oxide ore according to the present embodiment is a method for smelting using pellets of nickel oxide ore, by charging these pellets into a smelting furnace (reducing furnace), then reducing and heating. More specifically, as shown in the process chart of FIG. 1, this method for smelting nickel oxide ore includes a pellet production step S1 of producing pellets from nickel oxide ore, a reduction step S2 of reducing and heating the obtained pellets in a reducing furnace at a predetermined reduction temperature, and a recovery step S3 of recovering metal by separating the slag and metal generated in the reduction step S2.

<1.1. Pellet Production Step>

Figure 2:
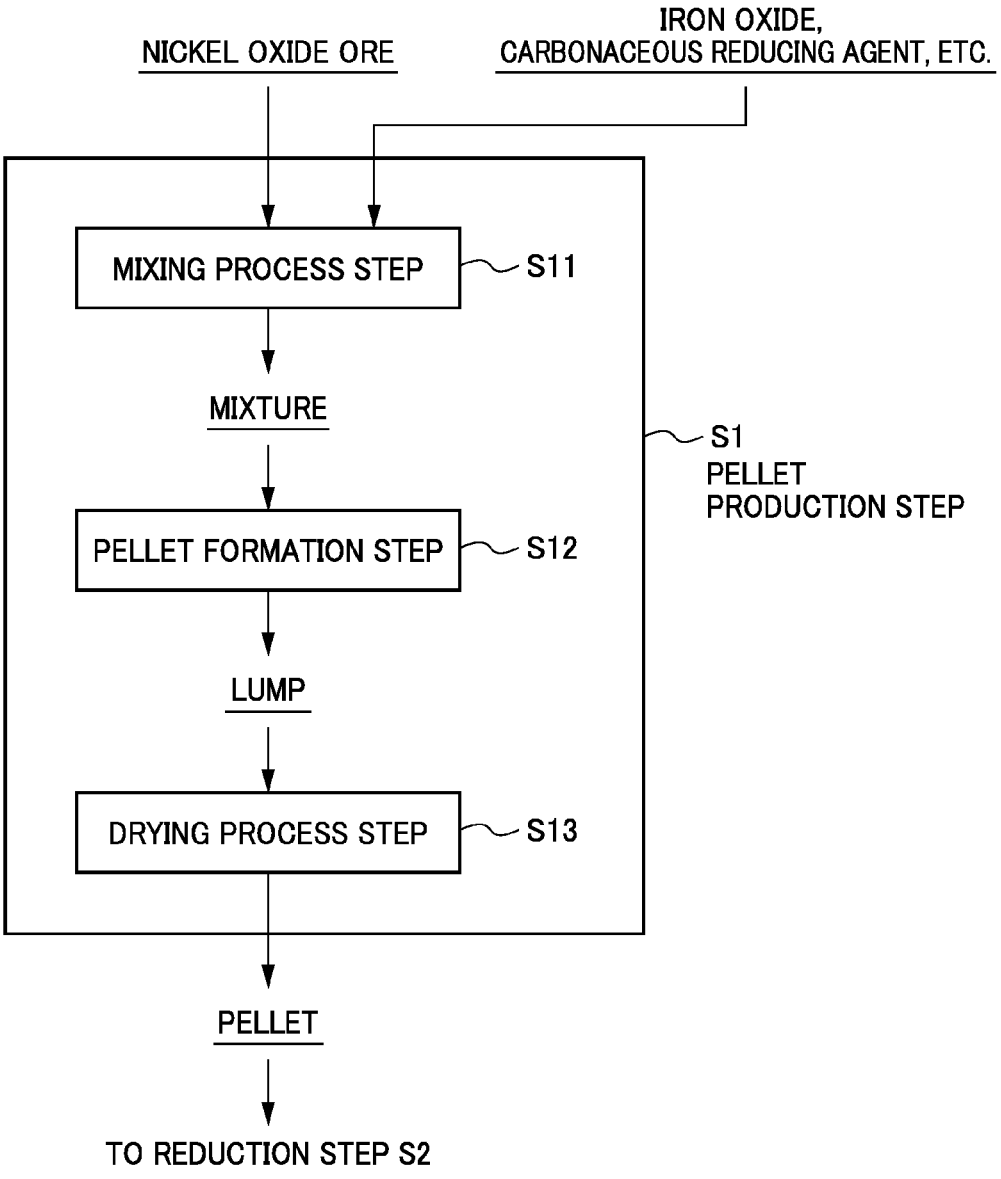
FIG. 2 is a process flowchart showing the flow of processes in a pellet production step of the method for smelting nickel oxide ore.

The pellet production step S1 produces pellets from nickel oxide ore, which is the raw material ore. FIG. 2 is a process flow chart showing the flow of processing in the pellet production step S1. As shown in FIG. 2, the pellet production step S1 includes a mixing process step S11 of mixing the raw materials including the nickel oxide ore, a pellet formation step S12 of forming (granulating) pellets, which are lumps, using the obtained mixture, and a drying process step S13 of drying the obtained pellets.

(1) Mixing Process Step

The mixing process step S11 is a step of obtaining a mixture by mixing the raw material powders including nickel oxide ore. More specifically, this mixing process step S11 obtains a mixture by mixing at least nickel oxide ore, which is the raw material ore, a carbonaceous reducing agent and iron oxide. It should be noted that, otherwise, it is possible to add and mix flux component, binder, etc. as necessary. Although the particle size of these raw materials is not particularly limited, a mixture is obtained by mixing raw material powders with a particle size on the order of 0.2 mm to 0.8 mm, for example.

The nickel oxide ore is not particularly limited; however, it is possible to use limonite ore, saprolite ore, etc.

In addition, powdered coal, pulverized coke, etc. are given as the carbonaceous reducing agent, for example. This carbonaceous reducing agent is preferably equivalent in particle size to the aforementioned nickel oxide ore.

In addition, as the iron oxide, for example, it is possible to use iron ore having an iron quality on the order of at least 50%, hematite obtained by wet smelting of nickel oxide ore, etc.

Otherwise, it is possible to give bentonite, polysaccharides, resins, water glass, dewatered cake, etc. as the binder, for example. In addition, it is possible to give calcium hydroxide, calcium carbonate, calcium oxide, silicon dioxide, etc. as the flux component, for example.

An example of the composition of a part of the raw material powders (wt %) is shown in Table 1 noted below. It should be noted that the composition of the raw material powder is not limited thereto.

TABLE 1

| Raw material powders [wt %] | Ni | $Fe_2O_3$ | C |
|---|---|---|---|
| Nickel oxide ore | 1~2 | 10~60 | — |
| (Limonite) | 1.0~1.2 | 30~60 | — |
| Iron ore (Iron oxide) | — | 80~95 | — |
| Carbonaceous reducing agent | — | — | ≈55 |

Herein, although described in detail later, in the present embodiment, upon mixing at least the nickel oxide ore, carbonaceous reducing agent and iron ore in this mixing process step S11 a mixture is generated such that the total weight of the nickel and iron contained in the pellets formed next in the pellet formation step S12 becomes at least a predetermined proportion. By adjusting the mixture for forming pellets in which the total weight of nickel and iron is at least a predetermined proportion in this way, the smelting reaction of pellets progresses effectively in the reducing heat treatment of the subsequent step using these pellets (reduction step S2), and thus it is possible to suppress the obtained ferronickel from becoming small grains.

(2) Pellet Formation Step

The pellet formation step S12 is a step of forming (pelletizing) the mixture of raw material powders obtained in the mixing process step S11 into pellets, which are lumps. More specifically, it forms pellets by adding the moisture required in agglomerating to the mixture obtained in the mixing process step S11, and using a lump production device (such as a rolling granulator, compression molding machine, extrusion machine), etc., or by the hands of a person.

The pellet shape is not particularly limited; however, it can be established as spherical, for example. In addition, although the size of the lump made into pellet form is not particularly limited, by passing through the drying process and preheat treatment described later, for example, it is configured so as to become on the order of 10 mm to 30 mm in size (diameter in case of spherical pellet) of pellet to be charged into the reducing furnace, etc.

In the present embodiment, the mixture for forming pellets for which the total weight of nickel and iron is at least a predetermined proportion is prepared in the mixing process step S11 as mentioned above. Due to this fact, the metal content of nickel and iron will be contained at a predetermined proportion in the pellets obtained in this pellet formation step S12, and in the reducing heat treatment of the subsequent process of the reduction step S2 using these pellets, the smelting reaction of pellets will progress effectively, and thus it is possible to suppress the obtained ferronickel from becoming small grains. It should be noted that the details will be described later.

(3) Drying Process Step

The drying process step S13 is a step of drying the pellets that are lumps obtained in the pellet formation step S12. The pellets (lumps) formed become a sticky state in which moisture is included in excess at about 50 wt %, for example. Therefore, in order to facilitate handling of this pellet, the drying process step S13 is configured to conduct the drying process so that the solid content of the pellet becomes on the order of 70 wt % and the moisture becomes on the order of 30 wt %, for example.

More specifically, the drying processing on the pellet in the drying process step S13 is not particularly limited; however, it blows hot air at 300° C. to 400° C. onto the pellet to make dry, for example. It should be noted that the temperature of the pellet during this drying process is less than 100° C.

An example of the solid content composition (parts by weight) of the pellet after the drying process is shown in Table 2 noted below. It should be noted that the composition of the pellet after the drying process is not limited thereto.

TABLE 2

| Composition of pellet solid content after drying [Parts by weight] | Ni | $Fe_2O_3$ | $SiO_2$ | CaO | $Al_2O_2$ | MgO | Binder | Other |
|---|---|---|---|---|---|---|---|---|
| Nickel oxide ore | 0.5~1.5 | 30~60 | 8~30 | 4~10 | 1~8 | 2~9 | 1 measure | Remainder |
| Limonite | 0.4~0.7 | 30~60 | 8~30 | 4~10 | 1~8 | 2~9 | 1 measure | Remainder |

The pellet production step S1 granulates (agglomerates) the mixture of raw material powders including nickel oxide ore, which is the raw material ore, as mentioned above, and dries this, thereby producing pellets. The size of the obtained pellet is on the order of 10 mm to 30 mm, and pellets having strength that can maintain shape, e.g., strength for which the proportion of pellets breaking is no more than about 1% even in a case causing to drop from a height of 1 m, are produced. Such pellets are able to endure shocks such as dropping upon charging into the reducing furnace in the subsequent process of the reduction step S2, and can maintain the shape of the pellets, and appropriate gaps are formed between pellets; therefore, the smelting reaction in the reduction step S2 will progress suitably.

It should be noted that, in this pellet production step S1, it may be configured so as to provide a preheat treatment step of preheat treating the pellets, which are lumps subjected to the drying processing in the aforementioned drying process step S13, at a predetermined temperature. In this way, by conducing preheat treatment on the lump after the drying process to produce a pellet in this way, it is possible to more effectively suppress heat shock-induced cracking (breaking, crumbling) of pellets. For example, it is possible to make the proportion of pellets breaking among all pellets charged into the reducing furnace a slight proportion at less than 10%, and thus possible to maintain the shape in at least 90% of the pellets.

More specifically, the pellets after the drying process are preheat treated at a temperature of 350° C. to 600° C. in the preheat treatment. In addition, it is preferable to preheat treat at a temperature of 400° C. to 550° C. By preheat treating a temperature of 350° C. to 600° C., preferably 400° C. to 550° C., in this way, it is possible to decrease the crystallization water contained in the nickel oxide ore constituting the pellets, and thus possible to suppress breaking of pellets due to desorption of this crystallization water, even in a case of making the temperature suddenly rise by charging into a reducing furnace at about 1400° C. In addition, by conducting such preheat treatment, the thermal expansion of particles such as the nickel oxide ore, carbonaceous reducing agent, iron oxide, binder and flux component constituting the pellets, becomes two stages and will advance slowly, whereby it is possible to suppress the breakage of pellets caused by the expansion difference between particles. It should be noted that, as the processing time of the preheat treatment, although it is not particularly limited and may be adjusted as appropriate according to the size of the lump containing nickel oxide ore, it is possible to set to a processing time on the order of 10 minutes to 60 minutes, if a lump of normal size for which the size of the obtained pellet will be on the order of 10 mm to 30 mm.

<1.2. Reduction Step>

The reduction step S2 heats the pellets obtained in the pellet production step S1 at a predetermined reduction temperature. By way of the reducing heat treatment of the pellets in this reduction process S2, the smelting reaction progresses, whereby metal and slag are formed.

More specifically, the reducing heat treatment of the reduction step S2 is performed using a smelting furnace (reducing furnace), and reduces and heats the pellets containing nickel oxide ore by loading into the reducing furnace heated to a temperature on the order of 1400° C., for example. In the reducing heat treatment of this reduction step S2, the nickel oxide and iron oxide in the pellet near the surface of the pellet which tends to undergo the reduction reaction first is reduced to make an iron-nickel alloy (ferronickel) in a short time of about 1 minute, for example, and forms a husk (shell). On the other hand, the slag component in the pellet gradually melts accompanying the formation of the shell, whereby liquid-phase slag forms in the shell. In one pellet, the ferronickel metal (hereinafter referred to simply as "metal") and the ferronickel slag (hereinafter referred to simply as "slag") thereby form separately.

Then, by extending the processing time of the reducing heat treatment of the reduction step S2 up to on the order of 10 minutes further, the carbon component of the surplus carbonaceous reducing agent not contributing to the reduction reaction contained in the pellet is incorporated into the iron-nickel alloy and lowers the melting point. As a result thereof, the iron-nickel alloy melts to become liquid phase.

As mentioned above, although the slag in the pellet melts to become liquid phase, it becomes a mixture coexisting as the separate phases of the metal solid phase and slag solid phase by subsequent cooling, without the blending together of the metal and slag that have already formed separately. The volume of this mixture shrinks to a volume on the order of 50% to 60% when comparing with the loaded pellets.

In the case of the aforementioned smelting reaction progressing the most ideally, it will be obtained as one mixture made with the one metal solid phase and one slag solid phase coexisting relative to one loaded pellet, and becomes a solid in a "potbellied" shape. Herein, "potbellied" is a shape in which the metal solid phase and slag solid phase join. In the case of being a mixture having such a "potbellied" shape, since this mixture will be the largest as a particle size, the time and labor in recovery will lessen and it is possible to suppress a decline in metal recovery rate upon recovering from the reducing furnace.

It should be noted that the aforementioned surplus carbonaceous reducing agent is not only mixed into the pellets in the pellet production step S1 and, for example, it may be prepared by spreading over the coke, etc. on the hearth of the reducing furnace used in this reduction step S2.

In the method for smelting nickel oxide ore according to the present embodiment, the pellet production step S1 generates a mixture so that the total weight of nickel and iron contained in the pellet to be formed becomes at least a predetermined amount, upon mixing at least nickel oxide ore, carbonaceous reducing agent, and iron oxide as mentioned above. By preparing the mixture in order to form pellets for which the total weight of nickel and iron becomes at least a predetermined amount in this way, the smelting reaction progresses effectively in the reducing heat treatment in the reduction step S2 using these pellets, and thus it is possible to suppress the obtained ferronickel from becoming small grains.

<1.3. Separation Step>

The separation step S3 recovers metal by separating the metal and slag generated in the reduction step S2. More specifically, a metal phase is separated and recovered from a mixture containing the metal phase (metal solid phase) and slag phase (slag solid phase) obtained by the reducing heat treatment on the pellet.

As a method of separating the metal phase and slag phase from the mixture of the metal phase and slag phase obtained as solids, for example, it is possible to use a method of separating according to specific gravity, separating according to magnetism, cracking by a crusher, etc., in addition to a removal method of unwanted substances by sieving. In addition, it is possible to easily separate the obtained metal phase and slag phase due to having poor wettability, and relative to the aforementioned "potbellied" mixture, for example, it is possible to easily separate the metal phase and slag phase from this "potbellied" mixture by imparting shock such as providing a predetermined drop and allowing to fall, or imparting a predetermined vibration upon sieving.

The metal phase (ferronickel) is recovered by separating the metal phase and slag phase in this way.

<<2. Formation of Pellets in Pellet Production Step>>

Next, the pellet production step S1 in the method for smelting nickel oxide ore will be explained in further detail. In the aforementioned way, the pellet production step S1 includes a mixing process step S11 of mixing the raw materials including nickel oxide ore, a pellet formation step S12 of forming pellets, which are lumps, by agglomerating the obtained mixture, and a drying process step S13 of drying the obtained pellets.

Then, in the present embodiment, this mixing process step S11 generates a mixture such that the total weight of nickel and iron contained in the pellets formed in the subsequent pellet formation step S12 becomes at least a predetermined proportion, upon mixing at least the nickel oxide ore, carbonaceous reducing agent and iron oxide. More specifically, it is characterized in preparing mixture so that the total weight of the metal components of nickel and iron contained in the pellets becomes at least 30 wt %.

The pellet obtained by preparing the mixture and agglomerating this mixture in this way have a high concentration of iron oxide and nickel oxide in this pellet, and when charged into the reducing furnace in the subsequent process which is the reduction step S2 the iron oxide and nickel oxide in the pellets will be reduced rapidly to an iron-nickel alloy, i.e. ferronickel (metal), and form a shell.

The formation of the shell in the reducing heat treatment in the reduction step S2 in the aforementioned way is important in order to make the smelting reaction progress ideally, whereby it is possible to effectively obtain ferronickel grains that are the largest in the size of particles, obtained as a mixture of one relative to one charged pellet (mixture made with one metal phase and one slag phase coexisting). Upon recovering ferronickel from this reducing furnace, the time and labor in recovery thereby decrease, and it is possible to suppress a decline in recovery rate. In addition, it is preferable to prepare a mixture so that the total weight of the metal components of nickel and iron contained in the pellet becomes at least 35 wt %, whereby it is possible to obtain ferronickel grains stably with the largest grain size.

As the ratio of metal components of nickel and iron contained in the pellet, although not particularly limited so long as this total weight is at least 30 wt % as mentioned above, when also considering the content ratio of carbonaceous reducing agent in order to make the smelting reaction progress more effectively, it is preferred to set no more than 55 wt % as the upper limit value thereof. In addition, from the point of a higher Ni quality of the ferronickel grain obtained after the reducing heat treatment in the reduction step S2 being advantageous as a stainless steel raw material, it is more preferable to generate a mixture so that the total weight of the metal components of nickel and iron becomes no more than 45 wt %.

In particular, in a case of using limonite or saprolite as the nickel oxide ore, which is the raw material ore, the Ni quality contained in these ores is low at on the order of 1%. For this reason, it is particularly preferable to set the total weight of the aforementioned metal components (nickel and iron) when adding iron oxide such as iron ore to at least 30 wt % and no more than 45 wt %, whereby it is possible to curb the Ni quality in the obtained ferronickel from declining.

In the above way, the present embodiment makes pellets by preparing a mixture by mixing at least nickel oxide ore, carbonaceous reducing agent and iron oxide so that the total weight of nickel and iron contained in the pellet to be formed becomes at least 30 wt %, and agglomerating this mixture, upon producing pellets to be used in the smelting reaction in the reduction step S2. By producing ferronickel, which is an iron-nickel alloy, by using pellets obtained in this way, in the subsequent process which is the reduction step S2, (1) it is possible to make the smelting reaction progress effectively, and (2) it is possible to suppress the ferronickel obtained after the smelting reaction from splitting into small grains.

EXAMPLES

Hereinafter, the present invention will be explained more specifically by showing Examples and Comparative Examples; however, the present invention is not to be limited to the following Examples.

Example 1

While adding a predetermined amount of water, nickel oxide ore (limonite) as the raw material ore (A), carbonaceous reducing agent (B) and iron oxide (C) were mixed so as to make the ratios thereof A:B:C=6:3:5, flux component of limestone and silica sand was further mixed so as to be $(CaO+MgO)/SiO_2$=0.6 to 2.5, thereby making a mixture of 50 wt % solid content and 50 wt % moisture. The component composition of nickel oxide ore, carbonaceous reducing agent and iron oxide (iron ore), which are the raw material powders used, is shown in Table 3 noted below.

TABLE 3

| Raw material powders [wt %] | Ni | $Fe_2O_3$ | C | Particle size [mm] (Measurement by sieving method) |
|---|---|---|---|---|
| Nickel oxide ore | 1.0 | 53 | — | 0.5 |
| Iron ore | — | 85 | — | 0.7 |
| Carbonaceous reducing agent | — | — | ≈55 | 0.4 |

Next, while adding water into the obtained mixture, it was kneaded by hand to form a spherical lump so that the pellet size when completed would be on the order of 10 mm to 30 mm. Then, this lump was dried so as to be 70 wt % solid content and 30 wt % moisture content, thereby forming a pellet.

The size (diameter) of the obtained pellet was about 17 mm. In addition, the total weight of nickel and iron contained in the pellet was 35 wt %.

Ten of the pellets formed were charged inside a reducing furnace heated to the reduction temperature of 1400° C., and the reducing heat treatment was conducted. Then, the state after 10 minutes elapsed since charging into the reducing furnace (completing the reduction reaction) was observed, and the number of ferronickel grains obtained was counted.

It should be noted that, since the number of ferronickel grains was greater than 10 if splitting in the middle of the smelting reaction (reduction reaction), the occurrence of splitting was evaluated by measuring the number of ferronickel grains. Since many ferronickel grains became very small at no more than 1 mm in the case of the ferronickel grains becoming 100 or more in number, measurement was stopped in the case of being more than 10 in number.

As a result thereof, the number of ferronickel grains obtained was 10, and the Ni content in this ferronickel was 1.7 wt %.

In this way, it was possible to make the smelting reaction progress effectively in Example 1, and thus possible to suppress the ferronickel obtained after the smelting reaction from splitting into small grains.

Example 2

Except for generating a mixture by mixing the raw material powders so as to make the ratios A:B:C=5.5:3:4.5, and producing pellets using this mixture, it was carried out similarly to Example 1. It should be noted that the size of the pellets obtained (diameter) was about 17 mm, and the total weight of nickel and iron in the pellet was 40 wt %.

As a result thereof, the number of ferronickel grains obtained was 10, and the Ni content in this ferronickel was 1.5 wt %.

In this way, it was possible to make the smelting reaction progress effectively in Example 2, and thus possible to suppress the ferronickel obtained after the smelting reaction from splitting into small grains.

Example 3

Except for generating a mixture by mixing the raw material powders so as to make the ratios A:B:C=6:3:3, and producing pellets using this mixture, it was carried out similarly to Example 1. It should be noted that the size of the pellets obtained (diameter) was about 17 mm, and the total weight of nickel and iron in the pellet was 30 wt %.

As a result thereof, the number of ferronickel grains obtained was 10, and the Ni content in this ferronickel was 1.7 wt %.

In this way, it was possible to make the smelting reaction progress effectively in Example 3, and thus possible to suppress the ferronickel obtained after the smelting reaction from splitting into small grains.

Example 4

Except for generating a mixture by mixing the raw material powders so as to make the ratios A:B:C=5:3:5, and producing pellets using this mixture, it was carried out similarly to Example 1. It should be noted that the size of the pellets obtained (diameter) was about 17 mm, and the total weight of nickel and iron in the pellet was 45 wt %.

As a result thereof, the number of ferronickel grains obtained was 10, and the Ni content in this ferronickel was 1.3 wt %.

In this way, it was possible to make the smelting reaction progress effectively in Example 4, and thus possible to suppress the ferronickel obtained after the smelting reaction from splitting into small grains.

Comparative Example 1

Except for generating a mixture by mixing the raw material powders so as to make the ratios A:B:C=9:3:1, and producing pellets using this mixture, it was carried out similarly to Example 1. It should be noted that the size of the pellets obtained (diameter) was about 17 mm, and the total weight of nickel and iron in the pellet was 25 wt %.

As a result thereof, the number of ferronickel grains obtained was 83, and thus had split into small grains. It should be noted that the Ni content in this ferronickel was 2.0 wt %.

Although it was possible to make the smelting reaction progress in Comparative Example 1, the ferronickel obtained after the smelting reaction split into small grains, and thus handling was very difficult.

Comparative Example 2

Except for generating a mixture by mixing the raw material powders so as to make the ratios A:B:C=10:3:0, and producing pellets using this mixture, it was carried out similarly to Example 1. It should be noted that the size of the pellets obtained (diameter) was about 17 mm, and the total weight of nickel and iron in the pellet was 20 wt %.

As a result thereof, the number of ferronickel grains obtained was 100 or more, and thus had split into small grains. It should be noted that the Ni content in this ferronickel was 4.0 wt %.

Although it was possible to make the smelting reaction progress in Comparative Example 2, the ferronickel obtained after the smelting reaction split into small grains, and thus handling was very difficult.

The invention claimed is:

1. A method for producing pellets to be used for producing an iron-nickel alloy, and produced by agglomerating a mixture obtained by mixing raw materials including nickel oxide ore, the method comprising:

a mixing process step of generating a mixture by mixing at least the nickel oxide ore, a carbonaceous reducing agent of an amount for obtaining an iron-nickel alloy by reduction, and iron oxide; and a pellet formation step of forming a pellet by agglomerating the mixture obtained, wherein the nickel oxide ore is limonite or saprolite, wherein the iron oxide is hematite obtained by wet smelting of nickel oxide ore or iron ore having an iron quality of at least 50 wt %, and wherein a mixture is generated in the mixing process step such that a proportion of a sum weight of nickel and iron accounting for the total weight of the pellet formed is at least 30 wt % and no more than 45 wt %.

2. The method for producing pellets according to claim 1, wherein the size of the obtained each pellet is in the range of 10 mm to 30 mm.

3. The method for producing pellets according to claim 1, further comprising a drying process step of drying the pellets that are lumps obtained in the pellet formation step.

4. The method for producing pellets according to claim 3, further comprising a preheat treatment step of preheat treating the pellets after the drying process step at a predetermined temperature.

5. The method for producing pellets according to claim 3, wherein the pellets after the drying process step are preheat treated at a temperature of 350° C. to 600° C. in a preheat treatment step.

6. A method for producing an iron-nickel alloy that produces the iron-nickel alloy from nickel oxide ore, the method comprising:

a pellet production step of producing a pellet from the nickel oxide ore; and a reduction step of heating the pellet obtained at a predetermined reduction temperature, wherein the pellet production step includes:

a mixing process step of generating a mixture by mixing at least the nickel oxide ore, a carbonaceous reducing agent and iron oxide; and a pellet formation step of forming a pellet by agglomerating the mixture obtained, wherein the nickel oxide ore is limonite or saprolite, wherein the iron oxide is hematite obtained by wet smelting of nickel oxide ore or iron ore having an iron quality of at least 50 wt %, and wherein a mixture is generated in the mixing process step such that a proportion of a sum weight of nickel and iron accounting for the total weight of the pellet formed is at least 30 wt % and no more than 45 wt %.

7. The method for producing an iron-nickel alloy according to claim 6, wherein a shell of iron-nickel alloy is formed at the vicinity of the surface of a pellet by heating the obtained pellet at a predetermined reduction temperature in the reduction step.

8. A method for producing an iron-nickel alloy that produces the iron-nickel alloy from nickel oxide ore, the method comprising:

a pellet production step of producing a pellet from the nickel oxide ore; and a reduction step of heating the pellet obtained at a predetermined reduction temperature, wherein the pellet production step includes:

a mixing process step of generating a mixture by mixing at least the nickel oxide ore, a carbonaceous reducing agent and iron oxide; and a pellet formation step of forming a pellet by agglomerating the mixture obtained, wherein the nickel oxide ore is limonite or saprolite, wherein the iron oxide is hematite obtained by wet smelting of nickel oxide ore or iron ore having an iron quality of at least 50 wt %, wherein a mixture is generated in the mixing process step such that a proportion of a sum weight of nickel and iron accounting for the total weight of the pellet formed is at least 30 wt %, and wherein a shell of iron-nickel alloy is formed at the vicinity of the surface of a pellet by heating the obtained pellet at a predetermined reduction temperature in the reduction step.

* * * * *